US007402127B2

(12) United States Patent
Rizzo

(10) Patent No.: US 7,402,127 B2
(45) Date of Patent: Jul. 22, 2008

(54) EXERCISE DEVICE

(76) Inventor: Peter A. Rizzo, 1564 Water St., Covington, KY (US) 41014-1355

( * ) Notice: Subject to any disclaimer, the term of this patent is extended or adjusted under 35 U.S.C. 154(b) by 0 days.

(21) Appl. No.: 11/465,957

(22) Filed: Aug. 21, 2006

(65) Prior Publication Data

US 2007/0087922 A1 Apr. 19, 2007

Related U.S. Application Data

(63) Continuation-in-part of application No. 10/908,313, filed on May 6, 2005, now Pat. No. 7,094,187.

(51) Int. Cl.
*A63B 21/00* (2006.01)

(52) U.S. Cl. ..... 482/135; 482/137; 482/62; 434/253

(58) Field of Classification Search ..... 482/51, 482/54, 67, 70, 71, 62, 135, 137, 139, 141, 482/57; 434/247, 253
See application file for complete search history.

(56) References Cited

U.S. PATENT DOCUMENTS 4,434,981 A 3/1984 Norton
4,506,884 A 3/1985 Hankin
4,529,194 A 7/1985 Haaheim
4,787,630 A 11/1988 Watson et al.
4,867,443 A 9/1989 Jensen
4,960,276 A 10/1990 Feuer et al.
5,102,122 A * 4/1992 Piane et al. ..... 482/133
5,110,117 A 5/1992 Fisher et al.
5,192,257 A 3/1993 Panasewicz
5,199,933 A * 4/1993 Illuzzi ..... 482/62
5,344,376 A 9/1994 Bostic et al.
5,368,533 A 11/1994 Feuer et al.
5,443,433 A 8/1995 Krag
5,643,162 A 7/1997 Landers et al.
5,921,899 A 7/1999 Rose
6,042,516 A * 3/2000 Norton ..... 482/70
6,120,415 A 9/2000 Paull et al.
6,837,838 B2 1/2005 List

* cited by examiner

*Primary Examiner*—Glenn Richman
(74) *Attorney, Agent, or Firm*—Lafkas Patent LLC; David M. Lafkas

(57) ABSTRACT

The present invention involves a method of securing an exercise device having an elongated base member with a linear track on a topside of the elongated base member to conventional exercise machine in order to exercise multiple muscle groups at once. A slidable body moves within the one or more linear tracks of the exercise device. The slidable body is attached to a pole to be gripped while exercising.

14 Claims, 8 Drawing Sheets

EXERCISE DEVICE

RELATED APPLICATION

The present application is a continuation-in-part of U.S. application Ser. No. 10/908,313 filed May 6, 2005 by Peter A. Rizzo.

BACKGROUND

The present invention relates to exercise equipment. In particular, the present invention relates to portable exercise equipment having user-defined variable resistance and substantially momentum free workout via one or more resistance poles or ropes attached tangentially to an elongated base member, the portable exercise equipment adaptable for use in conjunction with other exercise machines.

The popularity of personal exercise equipment has grown in the past decade at a feverish pace. As individuals' lives have become busier and more demanding, there is less time to spend going to the gym and completing a full, recommended exercise regiment. As such, more individuals are looking for exercise equipment that is efficient, effective, safe, and easy to store in their homes.

Numerous types of personal exercise equipment have been put forth, ranging from elaborate universal workout apparatuses to simple step boxes and dumbbells. Several of these personal exercise devices are portable, and others are stationary. The vast majority, however, are designed for a limited number of effective exercises.

Those known personal exercise devices designed for more effective body strength training, flexibility, cardiovascular health, or a combination thereof, typically involve various mechanical moving parts that may require regular maintenance and costly repairs if damaged. See, for example, Pilates' "Reformer."

Further, typical personal exercise equipment relating to strength training, flexibility, cardiovascular health, or combinations thereof, include a resistance based on weights or tension cords. Resistance based on weights obviously dramatically increases the heaviness of the overall equipment, thereby limiting movement and storage. Tension cords may stretch beyond effective use over time, thereby altering the actual exercise to be performed, and eventually require costly replacement of tension cords.

Typically, exercise machines and devices are designed and built to provide training to a specific set of muscles. However, the present exercise device may be used in conjunction with other exercise machines to increase the range of muscle groups that can be trained at the same time on other exercise machines.

Thus, what is desired is a cost effective, portable exercise apparatus used in conjunction with other exercise machines in order to efficiently and effectively provide strength, flexibility and cardiovascular training to an increased range of muscles than the exercise machine would do alone.

SUMMARY

The various exemplary embodiments of the present invention include a method of exercising comprising securing an exercise device to a weight training machine. The exercise device comprises an elongated base member, one or more linear tracks on a topside of the elongated base member, a slidable body having a locking means for retaining the slidable body in a predetermined position within the one or more linear tracks, and a pole or rope attached to the slidable body via one or more attaching means. While gripping the pole or rope, the individual performs an exercise movement as directed for the weight training machine while also gripping the pole or rope and moving groups of muscles while retaining hold of the pole with at least one hand.

BRIEF DESCRIPTION OF THE DRAWINGS

Various exemplary embodiments of the present invention, which will become more apparent as the description proceeds, are described in the following detailed description in conjunction with the accompanying drawings, in which.

DETAILED DESCRIPTION

The drawings show, for purposes of further illustration and understanding, that the various exemplary embodiments of the present invention are an exercise device, indicated generally by the reference number 10.

Figure 1:
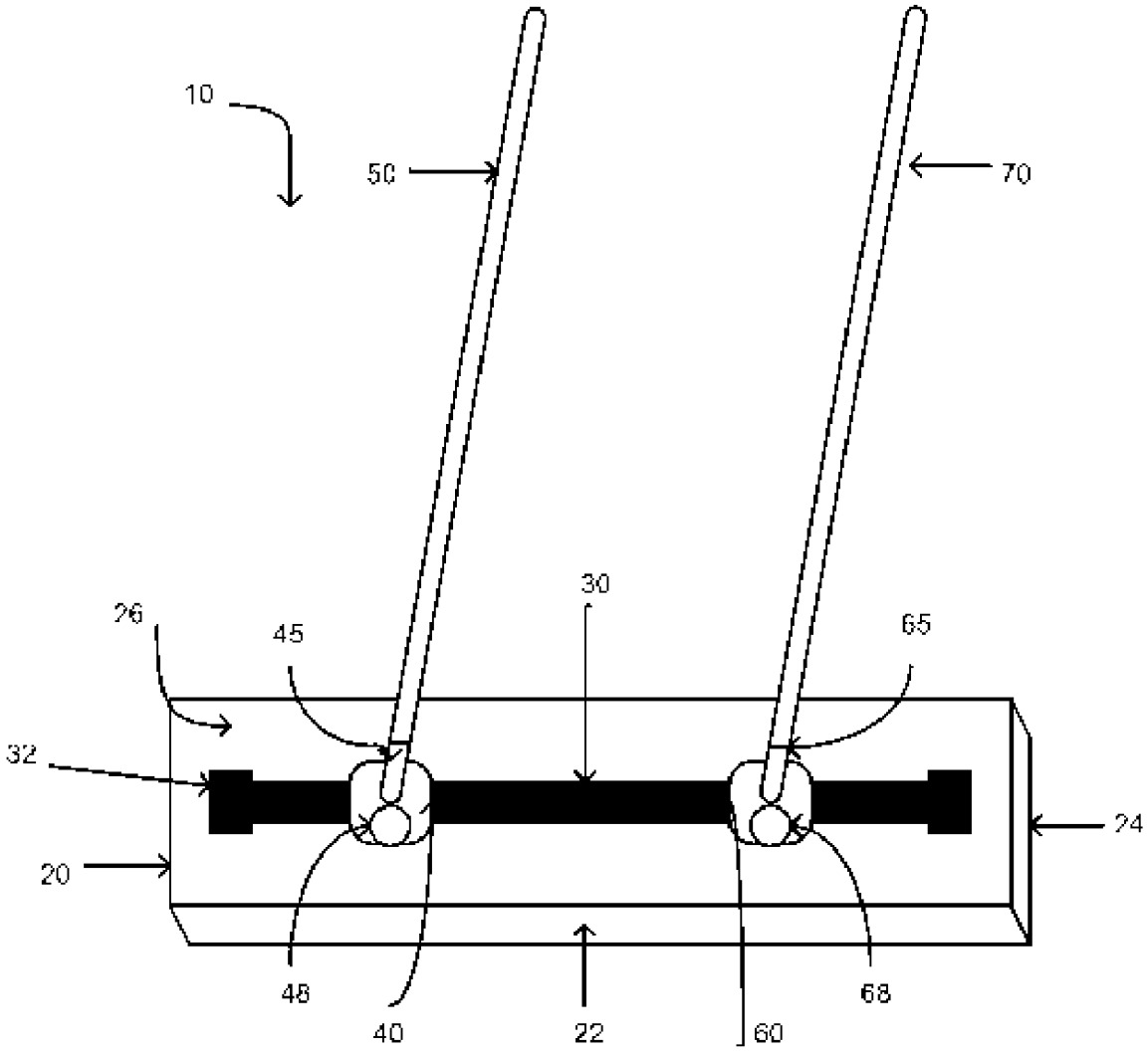
FIG. 1 is an illustration of an exemplary embodiment of the present invention having two poles.
Figure 2:
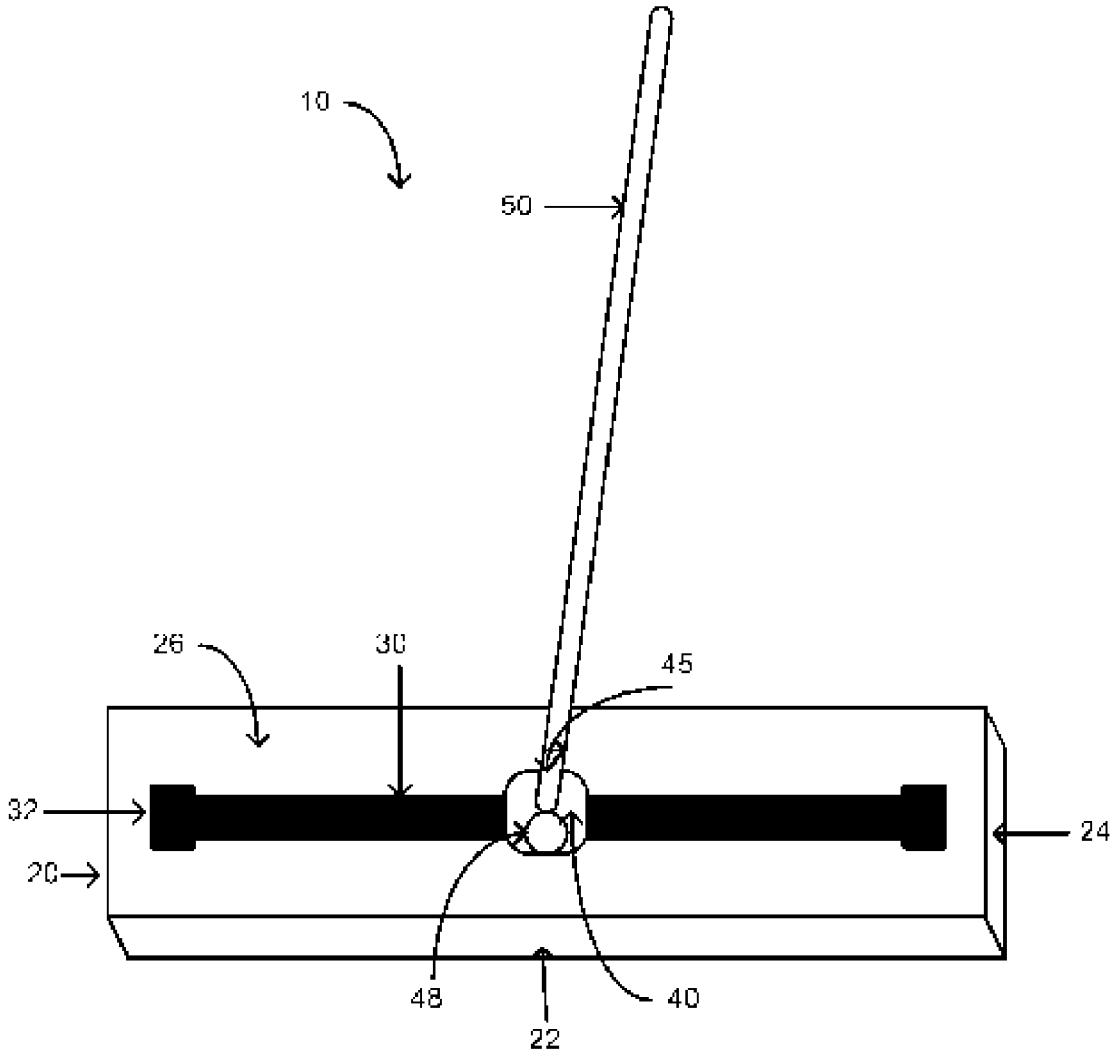
FIG. 2 is an illustration of an exemplary embodiment of the present invention comprising a single pole.

In the exemplary embodiment represented in FIG. 1, the exercise device is comprised of an elongated base member 20 having end walls 24 and edge walls 22. Although the elongated base member is shown in FIG. 1 as being substantially rectangular in shape, wherein the end walls are shorter in length than the edge walls, the elongated base member can be of any geometrical shape, for example, an oval, a curve, and the like.

The elongated base may be secured to a floor, wall or ceiling by way of one or more securing means, including, for example, one or more screws, one or more nails, adhesive, pressure fitting, one or more latches, rope, or a combination thereof. The securing means may be temporary or permanent.

On a topside 26 of the elongated base member, there exists one or more linear tracks 30. The linear track in FIG. 1 runs the length of the elongated base member, substantially parallel with the edge walls. However, the linear track need not run substantially parallel with the edge walls.

Figure 3:
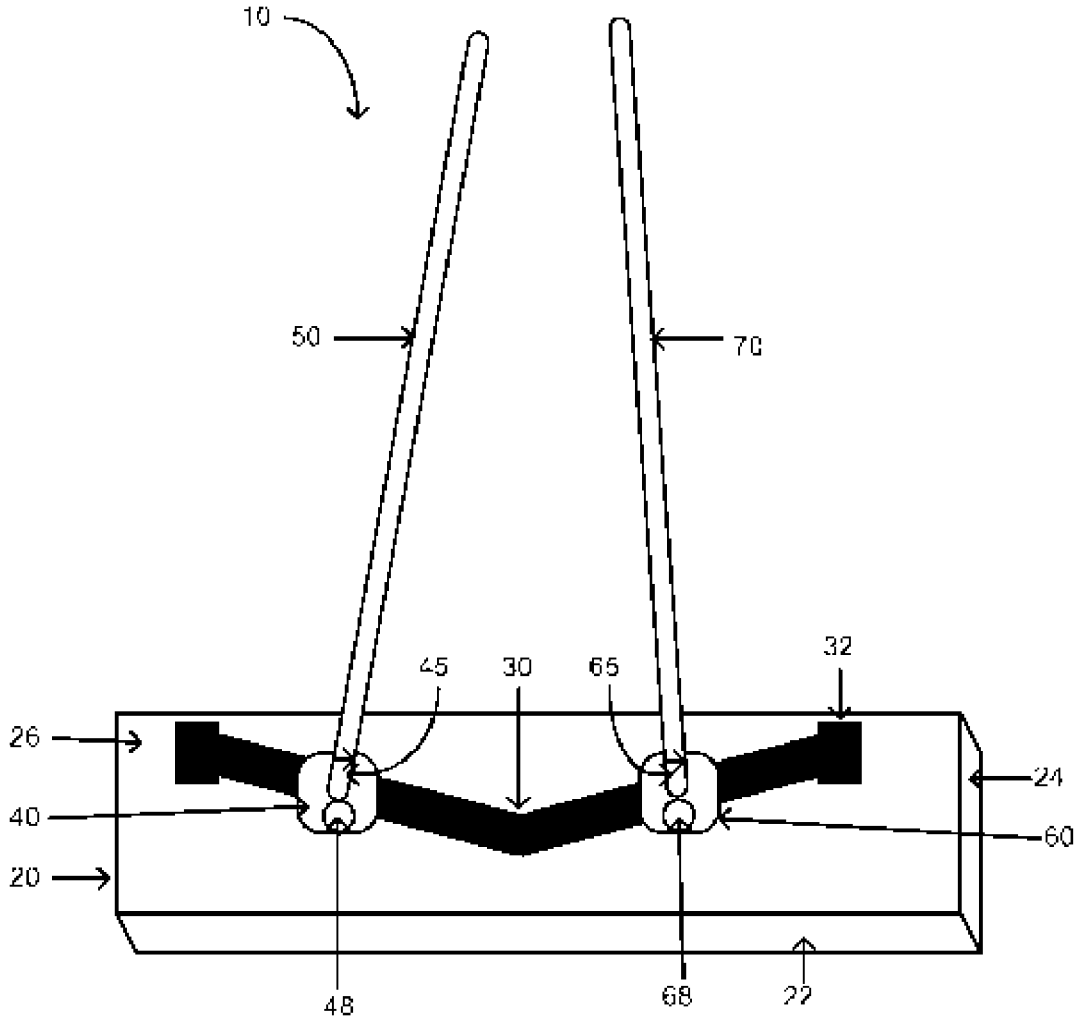
FIG. 3 is an illustration of yet another exemplary embodiment of the present invention, wherein the one or more linear tracks intersect in the shape of a "v."
Figure 4:
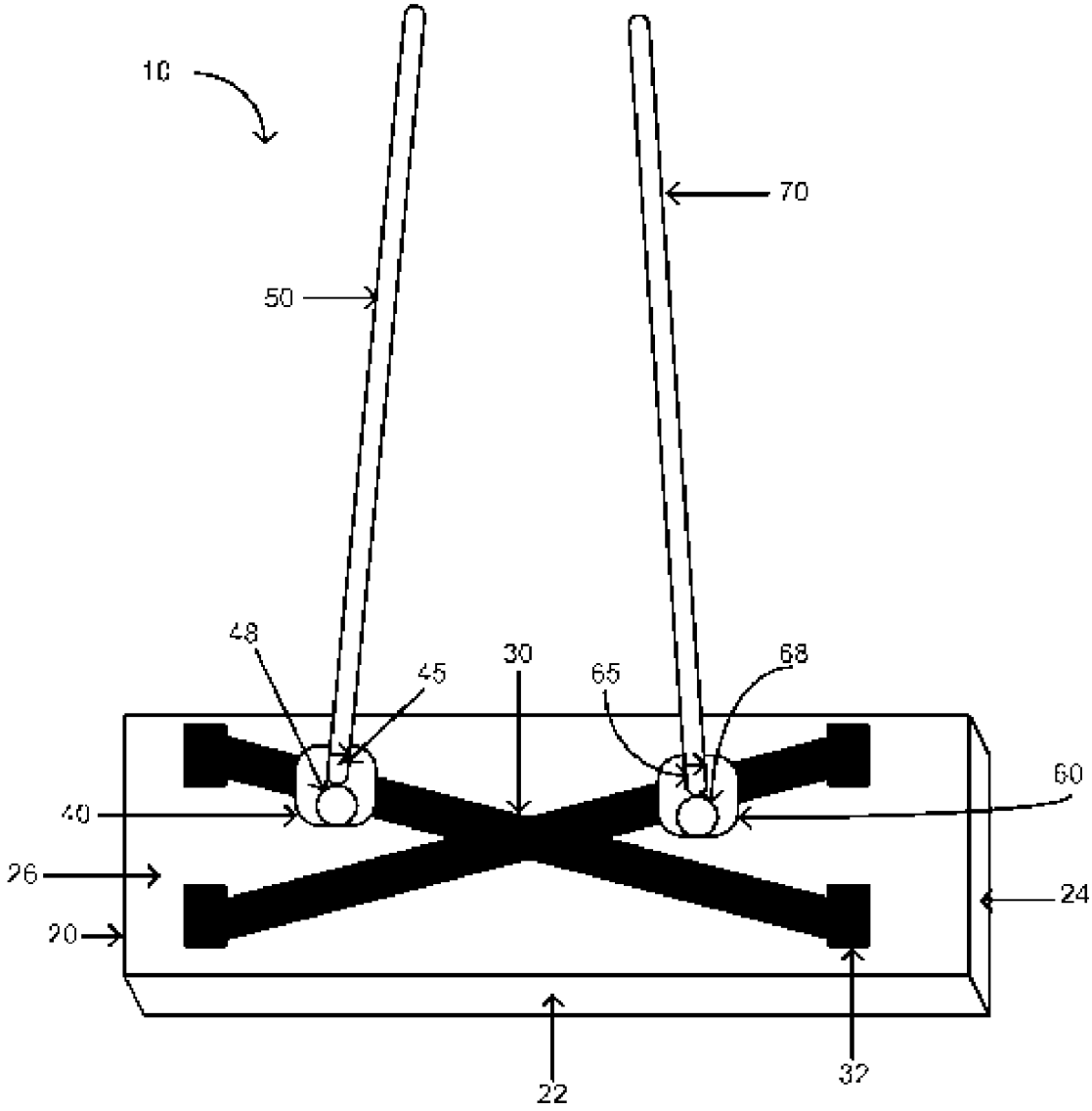
FIG. 4 is an illustration of another exemplary embodiment of the present invention, wherein the one or more linear tracts intersect in the shape of an "x."
Figure 5A:
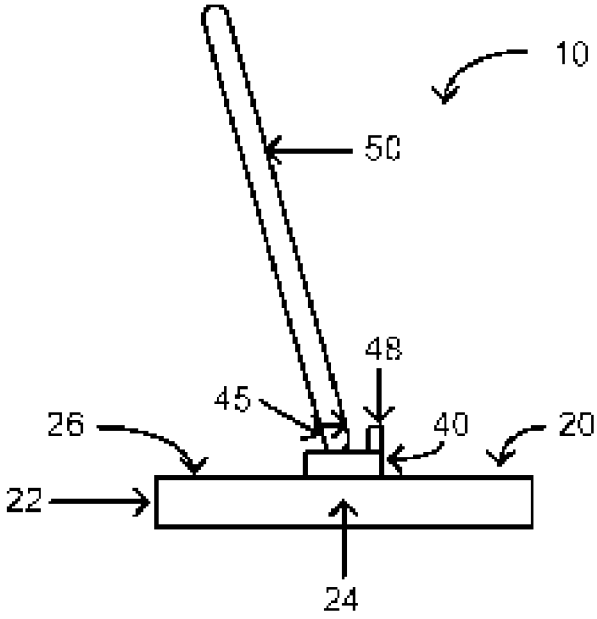
FIGS. 5*a* and 5*b* are side views of an exemplary embodiment of the present invention.
Figure 5B:
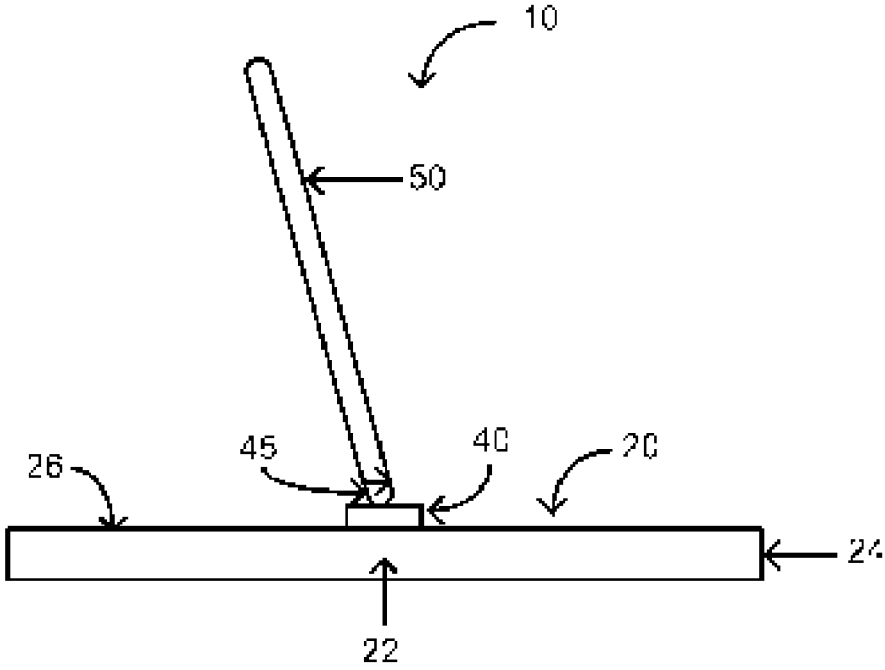

In the various exemplary embodiments, wherein there are multiple linear tracks, the multiple linear tracks may run parallel to one another or at an angle to one another. The multiple tracks may intersect one another in various exemplary embodiments. See, for example, FIG. 3, wherein two linear tracks intersect with one another in a "v" shape at about the center of the topside of the elongated base member. See, also, FIG. 4, wherein two linear tracks intersect with one another in an "x" shape at about the center of the topside of the elongated base member. The linear track may also be curved.

A first slidable body 40 rests in the one or more linear tracks such that it may be moved where desired within the one or more linear tracks. In various exemplary embodiments, a second slidable body 60 may also rest in the one or more linear tracks.

Selection points (not shown) may be evident along the one or more linear tracks to guide a predetermined position of the first slidable body, the second slidable body, or both. Such predetermined positions may be for different proposed exercises for individuals. The selection points may be in the form of visual marks, pin holes, a toothed bar, or the like.

The first slidable body 40 and the second slidable body 60 of the various exemplary embodiments may comprise a first locking means 48 and a second locking means 68, respectively.

The first locking means 48 and the second locking means 68 retain a desired or predetermined position of the respective slidable body within the one or more linear tracks. Such locking means may comprise, for example, a pin fitted into a respective hole (not shown) in the topside of the elongated base member along the linear track, a screw, a latch, and similar.

The slidable bodies may be moved anywhere along the linear track. Near the end walls 24 of the elongated base, the linear track has terminal stopping means 32. The slidable bodies, when in the linear track, may be moved anywhere between the terminal stopping means.

The first slidable body and the second slidable body of the various exemplary embodiments comprise a first attaching means 45 and a second attaching means 65, respectively.

The first and second attaching means allowed for joining the first slidable body with a first pole 50 and the second slidable body with a second pole 70.

In various exemplary embodiments, the first and second attaching means allow for joining the first slidable body with a first rope 90 and the second slidable body with a second rope (not-shown) 91. The first rope and second rope could be gripped and used by the individual for particular exercises more advantageous to one or more ropes. The first rope and second rope may be stretchable.

In the various exemplary embodiments, the first attaching means and the second attaching means may be a screw system wherein the pole screws into the attaching means, a pin and hole system, a latch system, a ball and socket, or similar.

The first pole and second pole of the various exemplary embodiments may be of any length or girth. In fact, different lengths and girths of poles may be desired for various exercise regimes. In addition, the pole may be comprised of metal, wood, plastic, or a combination thereof.

Although FIGS. 1-6 show the first pole and second pole as substantially straight, the first pole and second pole may be curved; stiff; flexible; comprise handles, grips, or both; or a combination thereof.

The first pole and second pole may be attached to the slidable body such that the first pole and second pole may pivot in various directions downward towards the elongated base by way of a universal joint, for example. See, for example, FIGS. 5*a* and 5*b*. If desired, the pole can be locked in a direction substantially perpendicular with the elongated base member.

In the various exemplary embodiments of the present invention, the slidable body may be attached to the first pole by way of a universal joint to allow the first pole to follow an ergonomic and more natural motion of the individual's body movement during an exercise.

Figure 6:
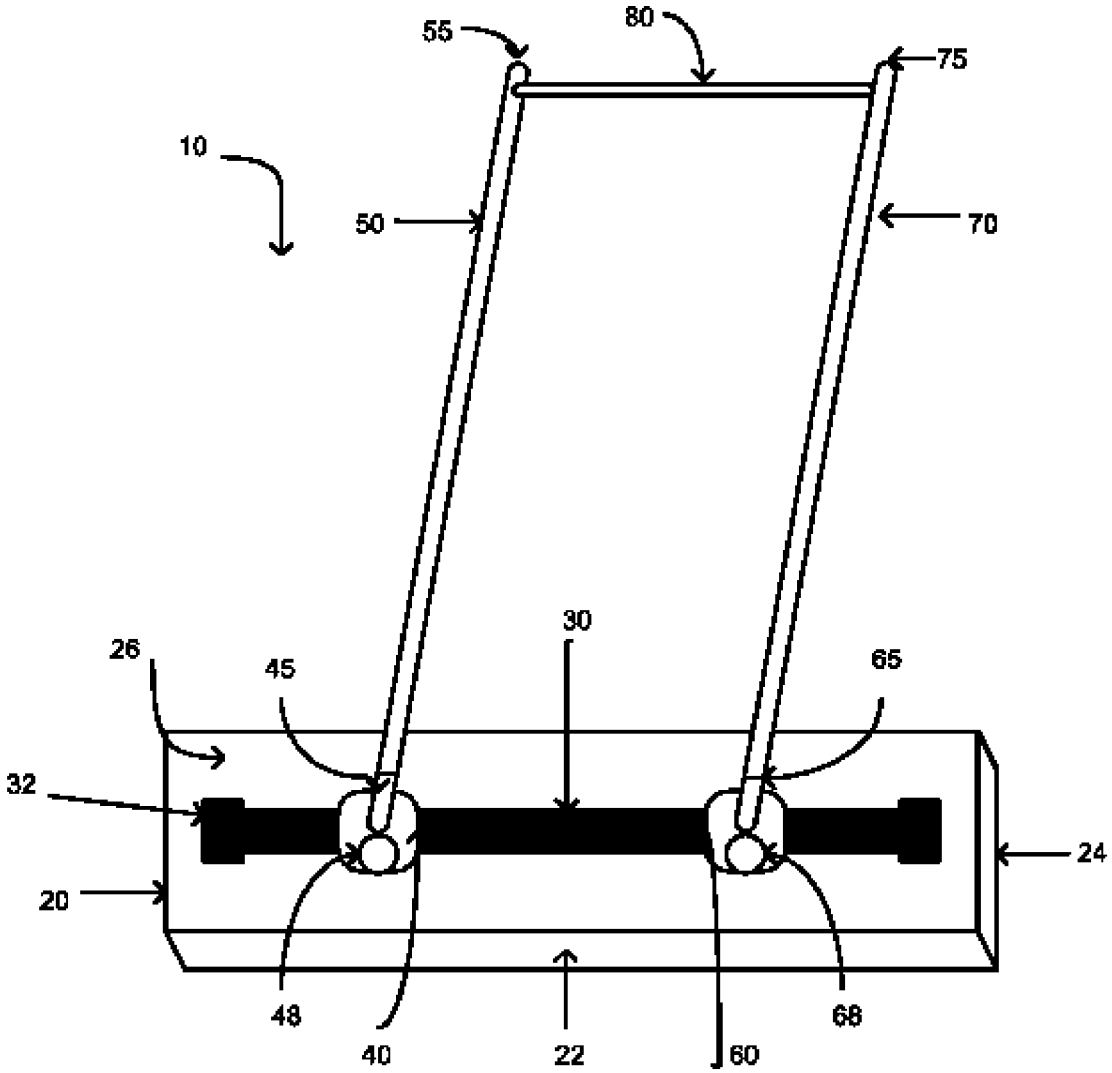
FIG. 6 is an illustration of another exemplary embodiment of the present invention having a connector between a first pole and a second pole.
Figure 7:
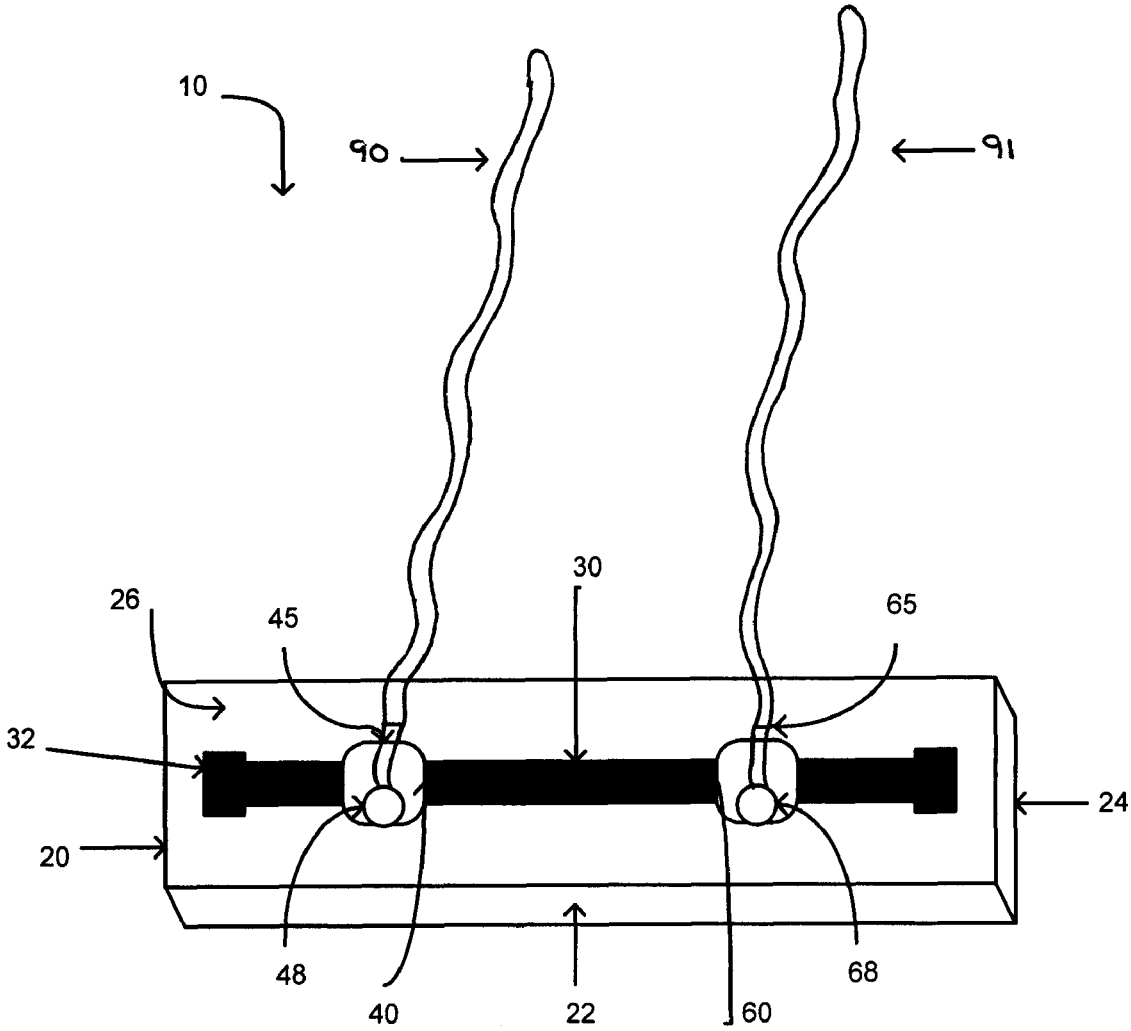
FIG. 7 is an illustration of another exemplary embodiment of the present invention having ropes in place of the poles.
Figure 8:
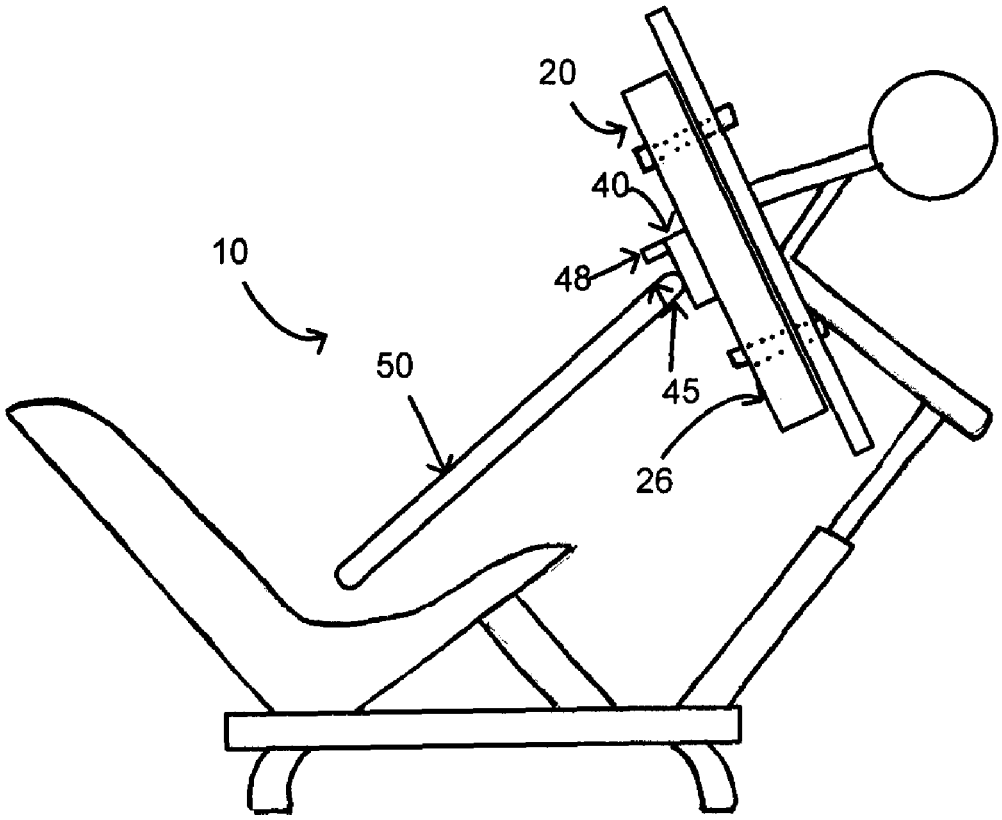
FIG. 8 is an illustration of an exemplary embodiment of the present invention as secured to a weight training machine.

As shown in FIG. 6, a connector 80 may be attached between the first pole and the second pole. The connected may be attached anywhere along the first pole between the first terminal end 55 and the first attaching means, and anywhere along the second pole between the second terminal end 75 and the second attaching means 65. In a preferred embodiment, the connector is attached at about the first terminal end 55 and at about the second terminal end 75.

The connector, when present, is preferably removable and held to the first pole and second pole by one or more screws, one or more latches, one or more pin and holes, one or more grips, or a combination thereof. The connector of the various exemplary embodiments allows for variation in exercise regimes wherein, for example, the first pole and second pole are to be separated at a predetermined length, that is, for example, the length of the connector.

The connector, as well as the first pole and second pole, may telescope in length.

In the various exemplary embodiments, the poles are gripped with the hands of an individual. The individual's grip on the poles may be with thumbs facing away from the elongated base, thumbs facing towards the elongated base, or a combination with one hand gripping one way and the other hand gripping another way.

While gripping the poles, an individual may perform a variety of exercises. For example, an individual may stand between a first pole and second pole as in the exemplary embodiment shown in FIG. 1. While gripping the poles, the individual may slowly bend his knees while keeping his back straight and sliding down the length of the poles towards the elongated base. Upon reaching a lower range of the bending his knees, the individual may then slowly unbend his knees while continuing to keep his back straight and sliding his hands back up the length of the poles away from the elongated base. Such an exemplary exercise strengthens gluteus, legs, lower back and abdomen muscle groups.

Increasing the amount of grip on the one or more poles in such an exercise may increase the effectiveness of the workout by stressing arm muscles and increasing the friction between hands and the one or more poles such that it is more difficult to extend the knees to stand erect.

In another exemplary exercise, the individual grips with both hands only the first pole. While gripping the first pole in front of his body, the individual bends his knees while keeping his back straight and sliding down the length of the pole towards the elongated base member before the unbending his knees and returning to a start position.

In another exemplary exercise, the individual may stand to one side of the first pole and bend to one side while gripping the pole.

The above exemplary exercises, in addition to simple stretching exercises, are just a few examples of a variety of exercise regimes that can be performed on the various exemplary embodiments of the present invention, and is not meant to be exhaustive.

The exertion of the exercise regime depends on several variables controlled by individual. For example, the individual's grip on the pole or poles increases the amount of friction between the individual and the pole. As such, to increase the exercise regime's effects and to more greatly maximize physical exhaustion, the individual may grip the poles to a greater extent. Obviously, the, having a lighter grip on the poles decreases the exercise when desired by the individual.

Likewise, the composition of the pole, the existence or lack thereof of gloves on the individual's hands, the composition of said gloves, other coverings for the hands, such as, for example, powder, can influence the extent of the exercise regime.

Most exercise machines commercially available are designed to train a specific or particular set of muscles. For example, a "leg press" weight training machine typically providing muscle training to legs and buttocks.

However, connecting the present exercise device to, for example, a leg press weight training machine increases the training of muscle groups to further include, for example, arms, chest, abdominals, and back muscles.

When used in conjunction with weight training machines 95, the elongated base member of the present exercise device is positioned where an individual would otherwise place his feet on the exercise machine. The elongated base member may be secured to the weight training machine via the one or more securing means 97. Examples of the one or more securing means include one or more screws, one or more nails, adhesive, pressure fitting, one or more latches, rope, or a combination thereof. The securing means maybe temporary or permanent. Once secured to the exercise machine, the individual positions himself to rest the bottom of his feet against the elongated base member and then use the particular exercise machine in addition to the present exercise device.

For example, the elongated base member may be placed against a foot rest of a leg press weight training machine such that one or more poles extend away from the base member in a direction away from the foot rest. The leg press weight training machine may be, for example, arranged such that a foot rest is positioned near the floor and a sliding back rest is arranged on a set of tracks connected to the foot rest and extending away from the foot rest at an angle between about 90 and about 0 degrees relative to the floor. Varying amounts of weight may be connected to the sliding back rest to increase the difficultly in moving the sliding back rest.

The individual then positions himself as directed for the particular leg press weight training machine and rests his feet against the elongated base member. The individual then performs the leg press exercise as directed for the particular leg press weight training machine, which may require for the individual to bend and then extend one's legs repeatedly. While performing the leg press exercise directed for the particular leg press weight training machine, the individual also grips the one or more poles to stress arm and upper-body muscles by increasing the friction between hands and the one or more poles. This allows the individual to train not only the leg muscles, but also the abdomen, back and upper body, thereby increasing the effectiveness of the exercise performed.

The leg press machine set forth above is merely one example of weight training machines to which the present exercise device may be secured in order to increase muscle training. Other exemplary weight training machines to which the present exercise device may be secured include abdominal crunch machines and back extension machines.

When the individual is finished with an exercise regime, the various exemplary embodiments of the present invention are neatly stored away. The poles can be pivoted to be substantially parallel with the elongated base member. The poles can be unattached from the respective slidable bodies and stored. In total, the exercise device is able to be easily stored under a bed or in a closet, for example.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention.

What is claimed is:

1. A method of exercising comprising:

securing an exercise device to a weight training machine via a securing device, the exercise device comprising an elongated base member, one or more linear tracks on a topside of the elongated base member, a slidable body having a locking means for retaining the slidable body in a predetermined position within the one or more linear tracks, and a pole attached to the slidable body via one or more attaching means, wherein the one or more linear tracks form a substantially straight line substantially perpendicular to end walls of the elongated base, an "x" shape on the topside of the elongated base member, a "v" shape on the topside of the elongated base member, or a combination thereof, positioning an individual on the exercise device on the weight training machine, and performing an exercise movement as directed for the weight training machine while also gripping the pole and moving groups of muscles while retaining hold of the pole with at least one hand.

2. The method according to claim 1, wherein a second pole is connected via one or more attaching means to a second slidable body, and the second pole is gripped with a second hand.

3. The method according to claim 1, wherein the first pole and the second pole are connected to each other via a connector.

4. The method according to claim 3, wherein the connector is telescopic.

5. The method according to claim 3, wherein the connector is attached at about a first terminal end and at about a second terminal end.

6. The method according to claim 1, wherein the weight training machine is selected from the group consisting of a leg press machine, an abdominal crunch machine, and a back extension machine.

7. The method according to claim 1, wherein the securing means is selected from the group consisting of one or more screws, one or more nails, adhesive, pressure fitting, and one or more latches, rope or a combination thereof.

8. A method of exercising comprising:

securing an exercise device to a weight training machine via a securing device, the exercise device comprising an elongated base member, one or more linear tracks on a topside of the elongated base member, a slidable body having a locking means for retaining the slidable body in a predetermined position within the one or more linear tracks, and a rope attached to the slidable body via one or more attaching means, wherein the one or more linear tracks form a substantially straight line substantially perpendicular to end walls of the elongated base, an "x" shape on the topside of the elongated base member, a "v" shape on the topside of the elongated base member, or a combination thereof, positioning an individual on the exercise device on the weight training machine, and performing an exercise movement as directed for the weight training machine while also gripping the rope and moving groups of muscles while retaining hold of the rope with at least one hand.

9. The method according to claim 8, wherein a second rope is connected via one or more attaching means to a second slidable body, and the second rope is gripped with a second hand.

10. The method according to claim 8, wherein the first rope and the second rope are connected to each other via a connector.

11. The method according to claim 10, wherein the connector is telescopic.

12. The method according to claim 10, wherein the connector is attached at about a first terminal end and at about a second terminal end.

13. The method according to claim 8, wherein the weight training machine is selected from the group consisting of a leg press machine, an abdominal crunch machine, and a back extension machine.

14. The method according to claim 8, wherein the securing means is selected from the group consisting of one or more screws, one or more nails, adhesive, pressure fitting, and one or more latches, rope or a combination thereof.

* * * * *